US006978584B1

(12) United States Patent
Burrow et al.

(10) Patent No.: US 6,978,584 B1
(45) Date of Patent: Dec. 27, 2005

(54) MULTIPLE LANE PACKAGING OF FEMININE SANITARY ARTICLES AND RESULTING PRODUCT

(75) Inventors: Ricky Ray Burrow, Doylestown, PA (US); Eberhard Dietrich Weitze, Skillman, NJ (US)

(73) Assignee: McNeil PPC, Inc., Skillman, NJ (US)

( * ) Notice: Subject to any disclaimer, the term of this patent is extended or adjusted under 35 U.S.C. 154(b) by 988 days.

(21) Appl. No.: 09/437,798

(22) Filed: Nov. 10, 1999

Related U.S. Application Data

(62) Division of application No. 09/050,483, filed on Mar. 30, 1998, now Pat. No. 6,115,997.

(51) Int. Cl.[7] ..... B65B 61/18
(52) U.S. Cl. ..... 53/412
(58) Field of Search ..... 53/412, 451, 550, 53/546, 553, 202, 443, 448, 133.8, 133.3, 133.1, 450

(56) References Cited

U.S. PATENT DOCUMENTS

| | | | | |
|---|---|---|---|---|
| 2,525,651 | A | * | 10/1950 | Clunan |
| 4,035,984 | A | * | 7/1977 | Gerlach et al. |
| 4,642,973 | A | * | 2/1987 | Cullen et al. |
| 4,706,439 | A | * | 11/1987 | Barton |
| 5,295,988 | A | * | 3/1994 | Muckenfuhs et al. |
| 5,345,750 | A | * | 9/1994 | Gries et al. |
| 5,484,636 | A | * | 1/1996 | Berg, Jr. et al. |
| 6,115,997 | A | * | 9/2000 | Burrow et al. |

* cited by examiner

*Primary Examiner*—Eugene Kim

(57) ABSTRACT

A package and apparatus and a method for assembling the package, of a feminine hygiene article, wherein the package is laminated around all the side edges of the article. The apparatus and method feature multi-lane processing wherein at least two parallel lanes of articles are processed simultaneously by laminating outer side edges of two opposed cover sheets, as well as the middle portion, with side-by-side articles disposed between the cover sheets.

1 Claim, 7 Drawing Sheets

MULTIPLE LANE PACKAGING OF FEMININE SANITARY ARTICLES AND RESULTING PRODUCT

This application is a division of application Ser. No. 09/050,483, filed on Mar. 30, 1998 now U.S. Pat. No. 6,115,997.

FIELD OF THE INVENTION

The present invention relates to a novel package for individual sanitary absorbent articles and to a multi-lane process and apparatus for producing the package. The package is particularly useful in packaging disposable feminine hygiene articles such as sanitary napkins, panty liners, incontinence pads and the like.

BACKGROUND OF THE INVENTION

Disposable feminine hygiene articles are conventionally packaged either in bulk quantities, or in individual packages. The latter have the advantage of allowing users to place one in a purse, handbag or automobile glove compartment, without the size problems created by the bulk package that contains quantities of the articles. Yet, the individual wrapping protects and conceals the article while so carried. This invention therefore, addresses the packaging of individual articles because of their convenience.

It is known to individually package disposable feminine hygiene articles, wherein a single cover sheet is wrapped around the article and sealed to itself optionally with a releasable tab provided with adhesive. Such packaging allows the user to open it by pulling on the tab, and to re-use the package by inserting a used version of the article inside the single cover sheet, wrapping it closed and re-sealing the tab.

As used herein, "disposable feminine hygiene articles" includes panty liners, sanitary napkins of all sizes, incontinence pads and the like, used by females.

A representative patent showing such packaging is U.S. Pat. No. 4,648,513.

Because the package is a single sheet wrapping, the packaging line therefor has been necessarily limited to a single lane process, wherein a continuous cover sheet is wrapped around single feminine hygiene articles placed sequentially on the continuous sheet. It has not been considered feasible to attempt to manufacture multiple lanes within a single continuous cover sheet, since by definition, any wrapping of that cover sheet does not produce a single wrapped article, only multiple ones. On the other hand, a single processing lane can be manufactured at only certain maximum speeds. To attain higher rates of productivity, multiple lane (across the width) processing is needed. Yet, as noted above, that is not feasible when the package comprises a single cover sheet wrapped around the single article.

Hence, prior to the invention there has been an unmet need to resolve the dilemma of using multi-lane processing but still wrapping only a single disposable feminine hygiene article at a time.

As used herein, "multi-lane package processing" means, a process and its incident apparatus wherein a plurality of, i.e. more than one, articles to be packaged are deposited side-by-side transverse to the direction they are being conveyed, and the packaging steps are carried out simultaneously on the plural articles, rather than sequentially as occurs in a single lane processing.

SUMMARY OF THE INVENTION

We have provided a solution to the above-noted unmet need.

More specifically, in accord with one aspect of the invention, there is provided a package of a disposable feminine hygiene article comprising:

first and second cover sheets having exterior edges, and an absorbent feminine hygiene article sandwiched between the sheets, the sheets being connected together only by laminations extending around all of the sheet edges to create closed edges of the package.

In accord with another aspect of the invention, there is provided a continuous method of assembling a packaged article in a multiple lane process, the method comprising the steps of:

a) providing in at least two parallel processing lines traveling in a predetermined direction, at least two disposable feminine hygiene articles, b) covering each of the articles in the parallel processing lines with a top and a bottom cover sheet, c) laminating the cover sheets together in the predetermined direction with the side-by-side articles confined between the sheets, d) simultaneous with or separate from step c), laminating the cover sheets together at a portion between the side-by-side articles, so that the side-by-side articles are isolated from each other by an intermediate lamination strip, e) simultaneous with or separate from step d), providing within the intermediate lamination strip, means for severing the laminated cover sheets along the intermediate strip, so that side-by-side packaged articles can be separated later into two isolated packaged articles, and f) severing along a line generally non-parallel to the predetermined direction, the laminated cover sheets with the side-by-side articles enclosed inside, while at the same time laminating the cover sheets together along the non-parallel line to form transverse edges that complete the sealing of the individual articles.

In accord with still another aspect of the invention, there is provided apparatus for continuously assembling a packaged feminine hygiene article in a multiple lane process, comprising:

a) means for providing in at least two parallel processing lines traveling in a predetermined direction, at least two disposable feminine hygiene articles, b) means for covering each of the articles in the parallel processing lines with a top and a bottom cover sheet, c) means for laminating the cover sheets together in the predetermined direction with the side-by-side articles confined between the sheets, d) means for laminating the cover sheets together in the predetermined direction, at a portion between the side-by-side articles, so that the side-by-side articles are isolated from each other by an intermediate lamination strip, e) means for providing a severing line in the laminated cover sheets along the intermediate strip, so that side-by-side packaged articles can be separated later into two isolated packaged articles, and f) means for severing along a line generally non-parallel to the predetermined direction, the laminated cover sheets with the side-by-side articles enclosed inside, while at the same time laminating the cover sheets together along the severing line to form transverse edges that complete the sealing of the individual articles.

Accordingly, it is an advantageous feature of the invention that individual feminine hygiene articles can be packaged in a multiple-lane process.

It is a related advantageous feature of the invention that novel individual feminine hygiene articles are packaged by that process.

Other advantageous features will become apparent upon reference to the following Detailed Description when read in light of the attached drawings.

DESCRIPTION OF THE PREFERRED EMBODIMENTS

The invention is described in particular with respect to certain preferred embodiments, in which preferred packaging material is laminated together around all the edges of a three- or four-edged single disposable feminine hygiene article, with preferred tear-open means being included in the package. The multi-lane package process and apparatus for the packaging is described in connection with two parallel lanes that are simultaneously processed.

In addition, the invention is useful regardless of the materials used for the packaging or feminine hygiene article, regardless of the number of side edges in the article, and regardless of the opening mechanism provided, if any, in the package. Also, the invention is applicable to multi-lane package processing of such articles, regardless of the number of parallel lanes that are processed simultaneously.

Figure 1:
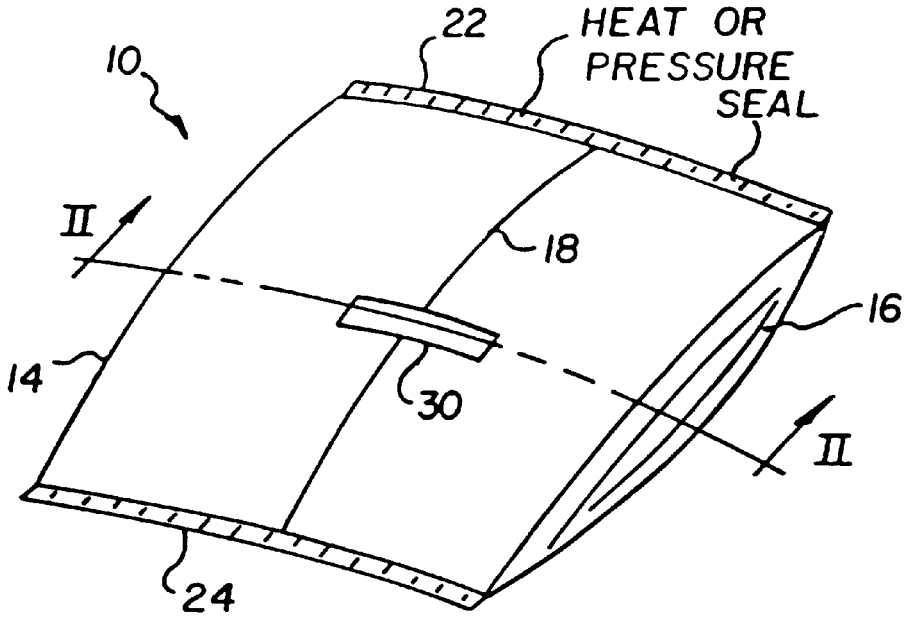
FIG. 1 (PRIOR ART)
FIG. 1 is an isometric view of a packaged disposable feminine hygiene article prepared in accordance with the prior art.
Figure 2:
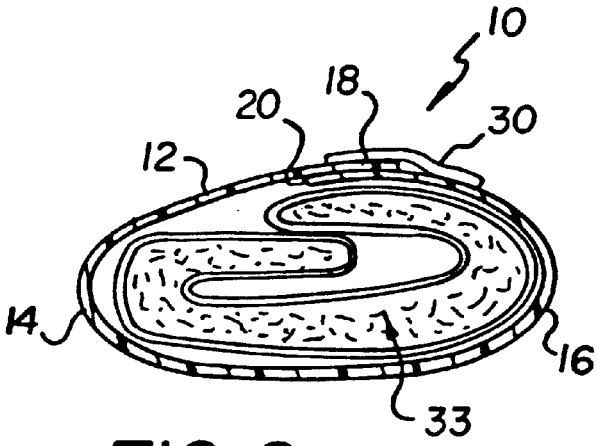
FIG. 2 (PRIOR ART)
FIG. 2 is an elevational section view taken generally along the plane II—II of FIG. 1.
Figure 3:
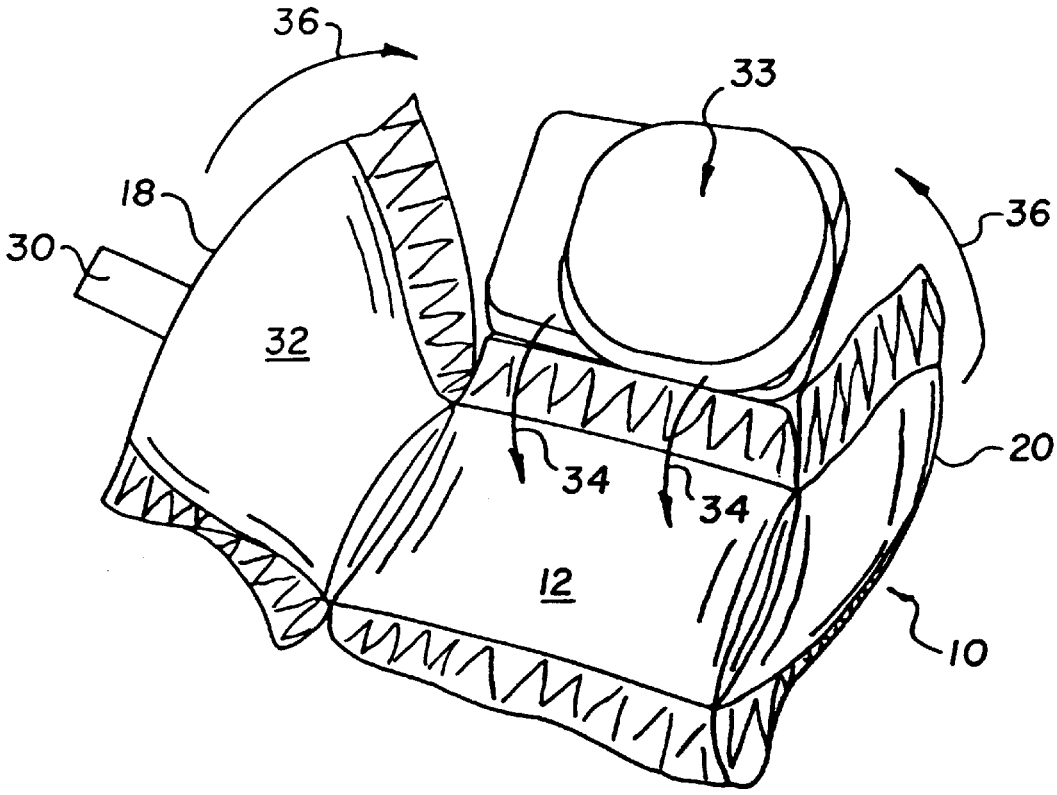
(PRIOR ART) FIG. 3
FIG. 3 is an isometric view of the package of FIG. 1, opened and ready to receive a used feminine hygiene article.

FIGS. 1–3 illustrate the conventional packaging described in the "Background" above, prepared by packaging a single lane of articles in sequential steps. That is, FIG. 1, an overall package 10 comprises a sheet 12 of film plastic, wrapped around and upon itself to create folded side edges 14,16, with the leading edge 18 overlapping the trailing edge 20, FIG. 2. The other two side edges 22,24 are laminated together by conventional process, FIG. 1. Sheet 12 can comprise a variety of materials, including but not limited to low- or high-density polyethylene, polypropylene, oriented polypropylene, paper, co-extruded or composite films of such materials, and such materials treated with sealing agents. Composite examples of such films include those having laminated or attached thereto, paper and other non-plastic sheet materials. A small adhesive strip 30 is used to temporarily tack edges 18 and 20 together with disposable feminine hygiene article 33 inside, FIG. 2. The latter article is a conventional absorbent article, either flat or folded, requiring no further discussion.

To obtain the article 33, strip 30 is released by the ultimate user from trailing edge 20 and sheet 12 is opened, FIG. 3. Optionally, a release agent is coated on surface 32 of sheet 12, as is conventional. When the article 33 is ready to be thrown away, the user simply re-inserts it, arrows 34, edges 18 and 20 are re-wrapped around it, arrows 36, and strip 30 is re-sealed.

Figure 4:
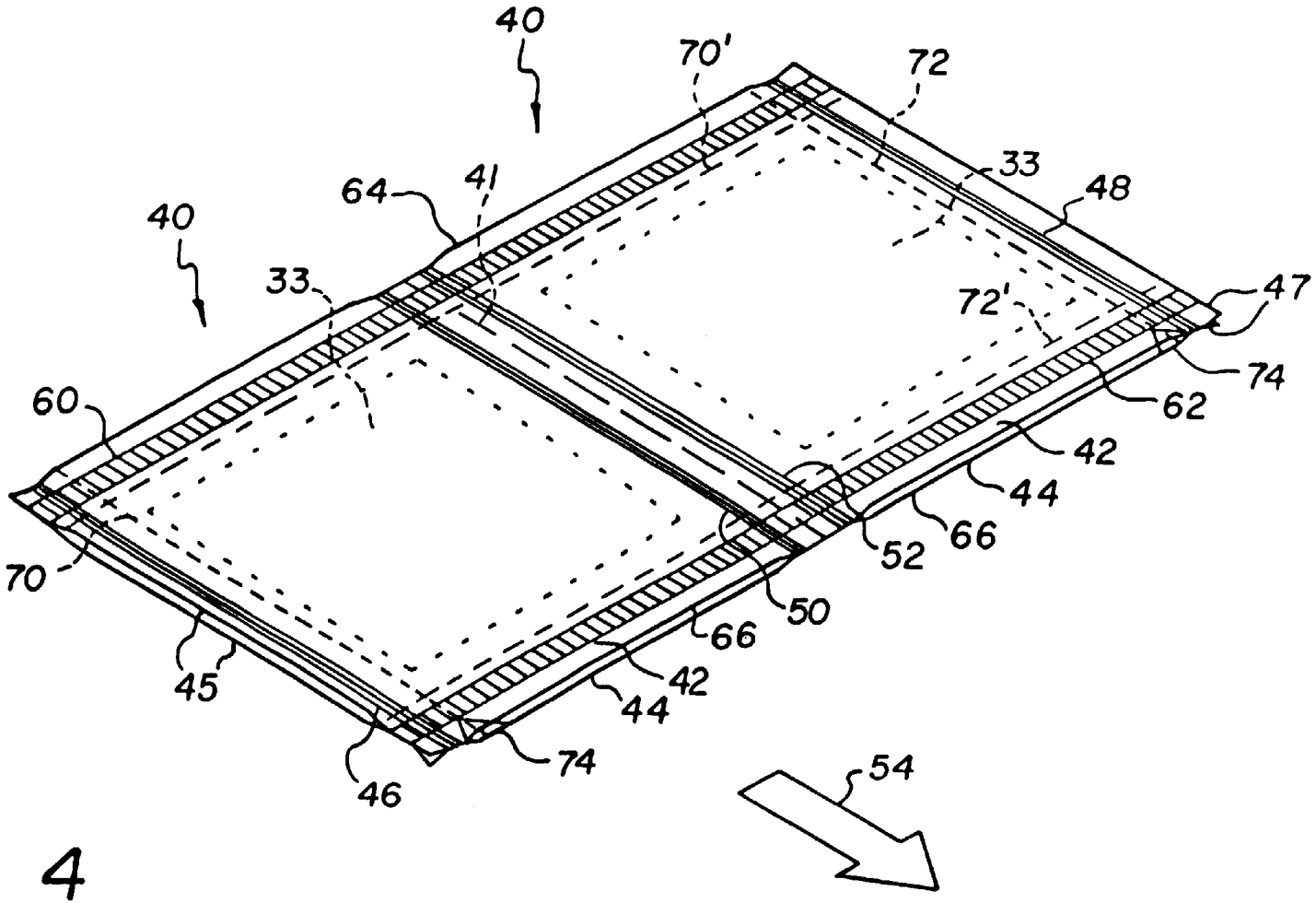
FIG. 4 is an isometric view of a packaged disposable feminine hygiene article prepared in accordance with the invention, and prior to separation into two separate packages.

In accordance with one aspect of the invention, a novel package 40 for a single article 33 is provided, two of which are shown temporarily integrally joined together along a common side edge 41, FIG. 4. As will become readily apparent, the two packages are substantially identical even though they are prepared as mirror images of each other. Article 33 is substantially the same as described for FIGS. 1–3.

Each package comprises two individual sheets, that is, top sheet 42 and bottom sheet 44 of the same plastic material as sheet 12. Each sheet 42 and 44 has opposite outside edges 45,47 that preferably are aligned. In those cases in which sheets 42 and 44 are otherwise identical, there is in fact no distinction between "top" and "bottom" except for the orientation appearing in the drawings. Hence, when the two packages are separated as discussed below, they are preferably substantially identical—unless printing material is placed on one of the sheets 42 and 44 and not on the other.

Alternatively, sheets 42 and 44 can in fact be each formed of different materials, in which case the two packages are not necessarily identical, but are rather true mirror images of each other.

However, the same top sheet 42 covers over both articles 33 and the same bottom sheet 44 underlies both articles in this embodiment. That is, sheet 42 of the one article 33 is an extension of sheet 42 of the other article 33, and the same is true for sheet 44. Closure of the sheets into a package is achieved in part by laminations 46,48 formed in sheets 42,44 between outside edge 45 and article 33, and outside edge 47 and the other article 33, respectively. Additionally laminations 50,52 are provided between articles 33 to separately enclose the latter away from each other, laminations 50,52 being generally parallel to each other, edge 41, and laminations 46,48, which in turn are generally parallel to outside edges 45 and 47, respectively. As used herein, "generally parallel" means, with no more than 2° variation from parallelism over a distance of 10 cm when measured in the direction of arrow 54.

As used herein, "lamination" or "laminated" refers to a bonding of the plastic by conventional processes, such as by heat and pressure to form a heat-seal, or by a hot-melt adhesive. The latter is preferred in some instances, because it provides a re-sealable interface. That is, if a hot-melt adhesive is used, the laminated portions themselves constitute means in the side edges of the packaged article for allowing that article to be opened by a user at the vicinity of the side edges. Further, if the hot-melt adhesive is tacky, that can be used to re-close the package with a used article re-inserted inside. Still further, if the lamination is formed via a bead of hot-melt adhesive, that bead and lamination can be continuous or intermittent. A continuous bead provides better dust protection for the article inside.

The other part of the closure of packages 40 is formed by laminations 60,62 that extend along a line that is preferably generally non-parallel to direction 54, and most preferably, generally perpendicular to direction 54. Preferably, laminations 60,62 are generally parallel to each other as defined above.

The packages then have transversely extending outside edges 64,66 in each of sheets 42,44, that are outside of laminations 60,62, respectively, and generally parallel thereto. These edges are formed during the packaging as described hereinafter.

To allow the two packages to be severed, one from the other, preferably during manufacturing, common side edge 41 is preferably intermittently perforated, creating a tear line. Because the tear line is in-between laminations 50,52, the separation of the two packages from each other does not alter the unopened status of the packages.

Preferably, side edges 45 and 47 include respective features allowing the ultimate user to tear open the individual package. A variety of such features can be used. As shown, a preferred example comprises intermittent perforations 70,72, located between lamination 46 or 48, respectively, and article 33.

Additionally, a portion of side edges 66 can be notched or prominently labeled at 74, to indicate to the ultimate user where perforations 70,72 commence.

Other useful examples of means for allowing the package to be opened adjacent the side edges 45 or 42 include a linear orientation of sheets 40,42 in the direction of arrow 54, so that the user can easily tear the sheets in that direction by twisting and tearing at either edges 64 or 66, as is well-known for packages of food articles and the like.

A release agent can be included on the undersurface of either or both sheets 42 and 44 that faces article 33, as in the case of conventional package 10 of FIG. 3.

Packaging Apparatus and Method

Figure 5:
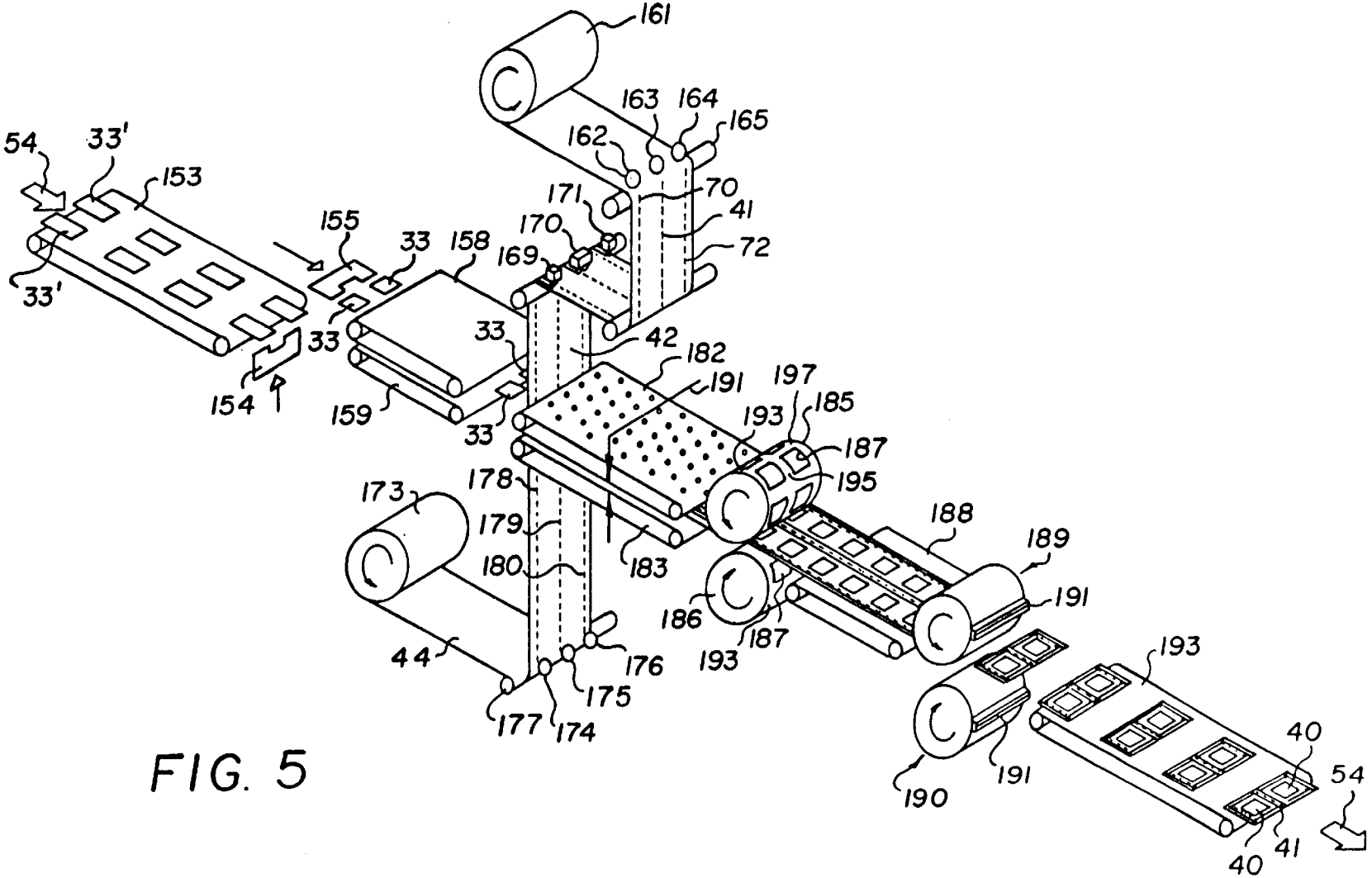
FIG. 5 is an isometric, partially schematic view of apparatus for assembling the packages of FIG. 4.

A novel apparatus and method are provided for multi-lane package processing, that is, for packaging articles 33 in multiple lanes simultaneously processed. A highly preferred example is shown in FIG. 5.

More particularly, to provide two parallel lanes of disposable feminine hygiene articles 33 for side-by-side processing, conventional conveyors 153, 158, and 159 are provided, with conventional folding apparatus 154 and 155 in between conveyors 153 and 158,159. Apparatus 154,155 folds the articles 33' into the form 33 such as is shown in FIG. 2. Thereafter both lanes of articles 33 are fed into means for covering the articles in parallel with a top and bottom sheet, and for laminating the sheets together. Such covering and laminating means preferably comprise a supply 161 of sheet 42 in conventional roll format, above conveyor 158, supply 173 of sheet 44 in conventional roll format below conveyor 159, conventional guide rollers 165 and 177, respectively for bringing sheets 42 and 44 between two opposed vacuum conveyor belts 182 and 183 to create a nip, and conventional opposed laminating rollers 185,186 having cavities 187 for accommodating the bulge of articles 33 between sheets 42 and 44, which feed the laminated sheets onto a conventional conveyor 188. Circumferentially-extending linear portions 193, 195 and 197 of the top lands of rollers 185 and 186 are the heated laminating portions. Cavities 187 are disposed so that rollers 185,186 heat-seal in direction 54, both the outside edges at 46 and 48, as well as in the middle between articles 33, at 50,52.

It is the nip 191 provided by sheets 42 and 44 carried by conveyors 182 and 183 into which the two lanes of articles 33 are inserted for processing.

The perforation lines 70,72,41 can be formed by laminating rollers 185,186, but most preferably they are formed by conventional perforating devices 162,163,164 on sheet 42 upstream of conveyors 182,183, and by conventional perforating devices 174,175,176 on sheet 44 upstream of conveyors 182,183. Alternatively, only one of the sheets 42 or 44 is perforated (by eliminating either the set 162,163,164 or the set 174,175,176 of perforating devices). This allows a user to tear open the package along the perforation of just the one cover sheet, leaving the other sheet unaffected and the side edges 45,45 or 47,47 still attached.

To sever temporary pairs of packaged articles from the continuous, laminated product carried by conveyor 188, along a line non-parallel to direction 54, and preferably perpendicular thereto, conventional opposed laminating and severing rollers 189 and 190 are provided downstream of conveyor 188, with cutting and laminating edges 191. These produce temporarily-joined packages 40 that feed onto a conventional conveyor 193, which delivers finished product pairs to either a boxing unit, or to opposed grippers (not shown) that grip and pull the two packages apart along perforation line 41.

Instead of operating rollers 189,190 so as to sever every advancing pair, as shown, rollers 189,190 instead can be optionally activated so as to produce temporarily joined blocks of 4,6,8, etc., not shown.

Still further, rollers 189,190 can include, in addition to edges 191, staggered knife edges that form a perforation 70' and/or 72', FIG. 4, that extends transverse to direction 54 in-between articles 33 and laminations 60,62 respectively. These perforations 70' or 72' constitute alternative means for opening the packages, apart from perforations 70,72.

In higher speed applications of the process described herein, conventional plastic sheets 42,44 may require application of hot-melt adhesives from applicators 169,170,171 to form the continuous bonding lines necessary for attachment of the top sheet 42 with the bottom sheet 44. Bonding of the sheets is then assisted by rollers 185,186 which provide for mechanically induced pressure between the sheets so as to assist the bonding process by setting the adhesive, or in the case of zone coated films, provide the necessary pressure to set the adhesives.

In yet another embodiment of the invention, applicator 170 is omitted, in which case rollers 185,186 provide heat-sealing laminations 50,52, whereas laminations 46 and 48 are provided by the hot-melt adhesives. Alternatively, the reverse can be true—only applicator 170 is used to apply hot-melt adhesive at laminations 50,52, and rollers 185,186 form laminations 46,48 by a heat-sealing process, using heat and pressure only.

The method of packaging achieved by this apparatus will be readily apparent from the preceding discussion. In addition, it will be readily apparent that, instead of laminating all four strips 46,48,50,52 all at once using rollers 185,186, the method may optionally form laminations 50,52 separate from the lamination 46,48, such as by using a separate set of lamination rollers (not shown) that apply heat and pressure only in the areas of strips 50,52, leaving rollers 185,186 to form only laminations 46,48.

Likewise, it is not necessary that perforation line 41 be formed upstream from rollers 185,186 as shown. Instead, line 41 can be perforated by the laminating rollers that laminate strips 50,52 (not shown).

In yet another alternative embodiment, tear-open perforation strips 70,72 can be disposed between lamination strips 50,52 and the respective inside article 53. This is readily achieved by moving perforating devices 162,164 and 174, 176 inboard so as to straddle, along with perforating device 163 and 175, respectively, the areas where lamination strips 50,52 are formed.

Figure 6:
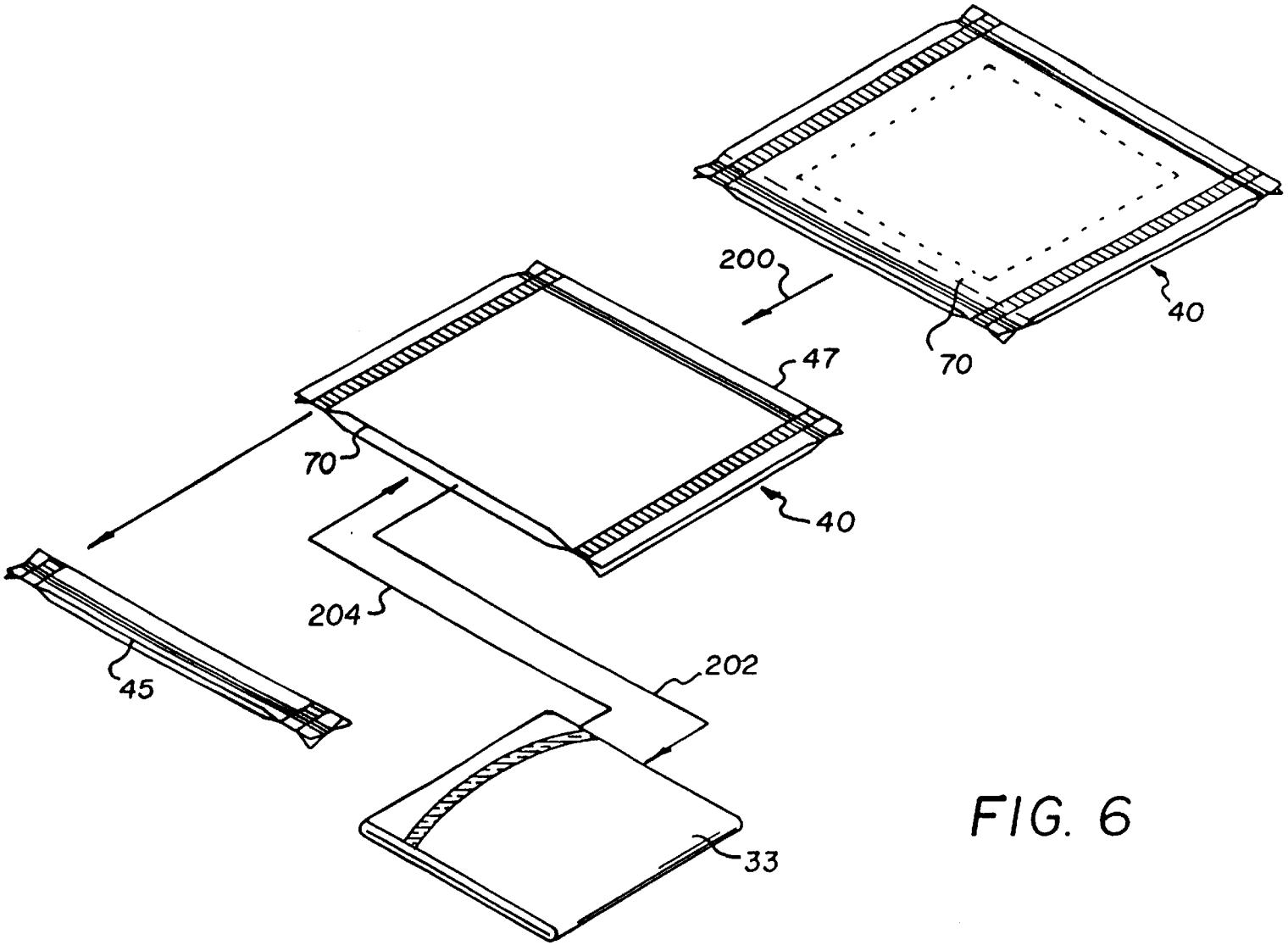
FIG. 6 is an isometric view of a single package of FIG. 4, illustrating a method of opening the package and reusing it for disposal.

FIG. 6 illustrates the manner in which package 40 is opened, and used to dispose of a used article 33. That is, the package is torn open along line 70, so that the package is open, arrow 200. Article 33 is then removed, arrow 202, used, and then the used article 33 is re-inserted, arrow 204.

Figure 7:
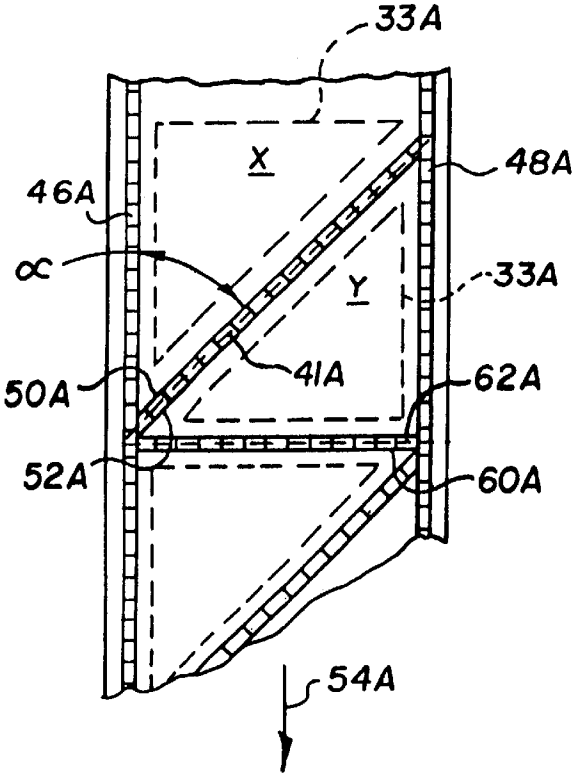
FIG. 7 is a fragmentary plan view of an alternative embodiment of the assembly method of the invention, showing the preparation of triangular packages.

Lamination and formation of perforations in-between side-by-side articles 33 to create laminations 50,52 and perforation line 41, FIG. 4, need not be along a direction generally parallel to direction 54. Instead, FIG. 7, it can be some non-orthogonal angle alpha, preferably about 45°. Parts similar to those previously described bear the same reference numeral, to which the distinguishing suffix "A" is appended. Thus articles 33A are folded so as to be generally equilateral triangles, and are placed side-by-side as at position "X" and "Y". Sheets 42A and 44A are then placed over and under, with laminations 46A and 48A formed as described above. However, laminations 50A,52A, and perforation line 41A are formed, using the pair of laminating rollers, at angle alpha to direction 54A. Laminations 60A and 62A, and any severing in the transverse direction, are formed as described above.

Still further, it is not necessary that the laminations sealing the sheets around the articles, such as laminations 46,46A; 48,48A; and/or 50,52; 50A,52A; be all straight-line formations. Alternatively, they can form curved lines, particularly if the enclosed feminine articles are curved, such as in an hour-glass shape (not shown). This is readily achieved by providing rollers 185,186 with heated curved portions of the top lands for forming the laminations, FIG. 5, rather than just linear portions 193,195,197.

Figure 8:
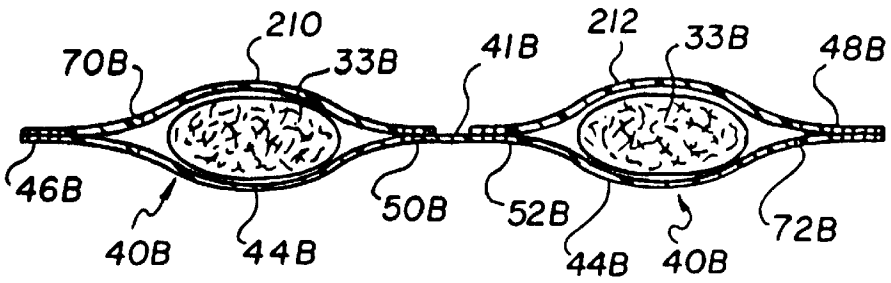
FIG. 8 is an elevational view in section of an alternative embodiment of the twin packages shown in FIG. 4.

In yet another alternative embodiment, it is not essential that both cover sheets be contiguous and integral from side edge 45 to side edge 47. Thus, as shown in FIG. 8, one of the cover sheets has been pre-slit into two separate sheets. Parts similar to those previously described bear the same reference numeral, to which the distinguishing suffix "B" is appended.

Thus, packages 40B are formed as described above to enclose articles 33B using laminations such as at 46B,48B, 50B,52B, with tear perforations at 41B,70B,72B also as described above. What is different is that the top cover sheet comprises two separate sheets 210,212 laminated to a single bottom cover sheet 44B.

Figure 9:
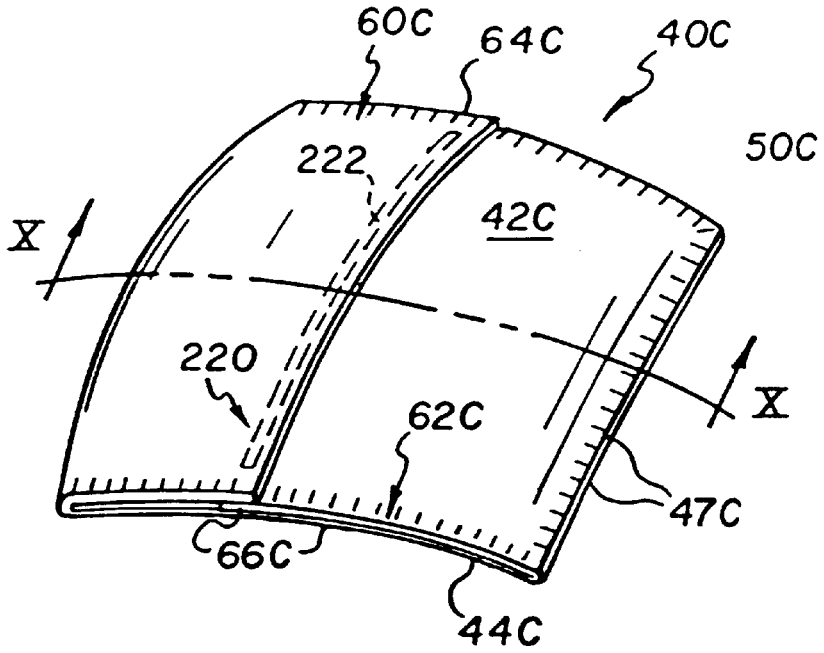
FIG. 9 is an isometric view similar to FIG. 4, but of yet another alternative embodiment of the package.
Figure 10:
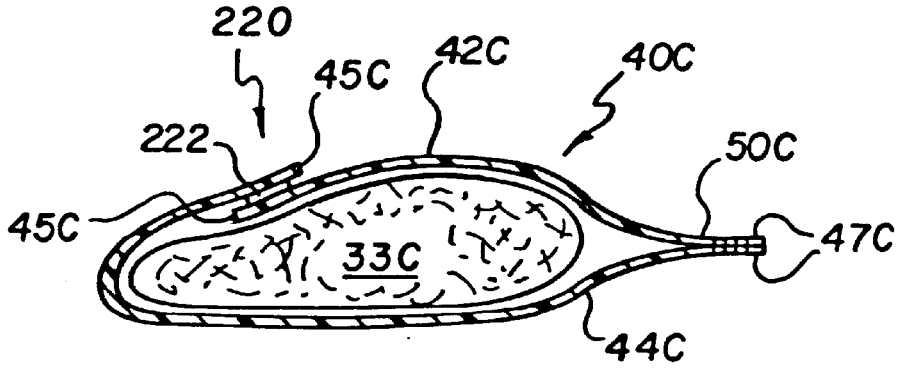
FIG. 10 is a section view taken generally along the line X—X of FIG. 9.

Referring again to FIG. 4, although the packages 40 have laminations 46, 48, 50, 52, 60 and 62 extending around all the edges at locations exterior to the packaged article 33, such laminations need not all be exterior to the article. FIGS. 9 and 10 illustrate an embodiment in which the laminations extend around all the side edges of the cover sheets, but one of them is in-board the article. Parts similar to those previously described bear the same reference number, to which suffix "C" is appended. Thus, package 40C of article 33C, FIG. 10, comprise top and bottom cover sheets 42C and 44C, exterior edges 47C of the sheets being laminated, preferably by heat and pressure, at 50C, 60C, and 62C, around three of the four side edges of sheets 42C and 44C, just as in the embodiment of FIG. 4. However, the fourth lamination is lamination 220 formed from a hot-melt adhesive. It is located at 222 between bottom sheet 44C wrapped around article 33C and over edge 45C of top cover sheet 42C. Thus, the location of lamination 220 is mostly in-board the peripheral edges of article 33C, and extends all the way from side edges 64C to 66C, FIG. 9.

Thus, the package side edges are four in number, each being laminated: side edges 45C are laminated at 220, side edges 47C at 50C, side edges 64C at 60C, and side edges 66C at 62C. However, as noted in FIG. 7, the number of side edges to the package can be other than four, e.g., three.

This process thus produces the packaged article described above—one with the two opposed sheets of the package laminated together around all side edges of the package. This distinguishes the package from the single-sheet wrapped package of the prior art.

The invention disclosed herein may be practiced in the absence of any element which is not specifically disclosed herein.

The invention has been described in detail with particular reference to preferred embodiments thereof, but it will be understood that variations and modifications can be effected within the spirit and scope of the invention.

What is claimed is:

1. A package of a disposable feminine hygiene article comprising:

first and second cover sheets having exterior edges, and an absorbent feminine hygiene article sandwiched between said sheets, said sheets being connected together only by laminations extending around all of said sheet edges to create closed edges of said package, wherein at least one of said laminations permits the package to be opened, and once opened, said at least one of said laminations permits the package to be resealed.

* * * * *